US008276654B2

(12) United States Patent
Zaffetti et al.

(10) Patent No.: US 8,276,654 B2
(45) Date of Patent: Oct. 2, 2012

(54) CORE ASSEMBLY WITH DEFORMATION PREVENTING FEATURES

(75) Inventors: Mark Zaffetti, Suffield, CT (US); Kurt Stephens, Enfield, CT (US); William J. Phillips, Chicopee, MA (US); Irving O'Strander, Springfield, MA (US); Michael Spineti, Newington, CT (US); Virat Saidha, Coatesville, PA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 993 days.

(21) Appl. No.: 11/281,137

(22) Filed: Nov. 17, 2005

(65) Prior Publication Data

US 2007/0107889 A1 May 17, 2007

(51) Int. Cl.
*F28F 3/10* (2006.01)

(52) U.S. Cl. ..... 165/166

(58) Field of Classification Search ..... 165/166, 165/167, 170

See application file for complete search history.

(56) References Cited

U.S. PATENT DOCUMENTS

| | | | | |
|---|---|---|---|---|
| 1,688,147 | A * | 10/1928 | Levron | 165/166 |
| 1,775,819 | A * | 9/1930 | Fischer et al. | 165/170 |
| 2,170,484 | A * | 8/1939 | Prat | 165/166 |
| 2,368,814 | A * | 2/1945 | Fagan | 165/166 |
| 2,634,958 | A * | 4/1953 | Simpelaar | 165/71 |
| 3,517,731 | A * | 6/1970 | Rothman | 165/70 |
| 3,601,185 | A * | 8/1971 | Rothman | 165/166 |
| 4,442,886 | A * | 4/1984 | Dinulescu | 165/166 |

FOREIGN PATENT DOCUMENTS

| | | |
|---|---|---|
| FR | 2439971 | 5/1980 |
| FR | 2855600 | 12/2004 |
| JP | 60-189782 | 12/1985 |
| JP | 62-39186 | 3/1987 |
| JP | 7-167579 | 7/1995 |
| JP | 8-159684 | 6/1996 |
| JP | 11-153389 | 6/1999 |
| JP | 2002-160032 | 6/2002 |
| JP | 2002-339810 | 11/2002 |
| JP | 2004-162552 | 6/2004 |
| JP | 11183063 | 4/2007 |

OTHER PUBLICATIONS

European Search Report dated Mar. 27, 2007.
Japanese Office Action dated Mar. 24, 2009.
Japanese Office Action dated Aug. 25, 2009.

* cited by examiner

*Primary Examiner* — Leonard R Leo
(74) *Attorney, Agent, or Firm* — Carlson, Gasksey & Olds, P.C.

(57) ABSTRACT

A heat exchanger assembly includes a core assembly having air passages that are closed off on at least one side by a closure bar. A reinforcing bar is received within a channel of the closure bar to create an interface with substantially no gaps that may accumulate moisture within the core assembly. The prevention of moisture accumulation at the interface between the reinforcing bar and the closure bar prevents potential damage caused by freezing.

18 Claims, 3 Drawing Sheets

CORE ASSEMBLY WITH DEFORMATION PREVENTING FEATURES

BACKGROUND OF THE INVENTION

This invention generally relates to a heat exchanger and method of fabricating a heat exchanger. More particularly, this invention relates to a method of fabricating a core assembly for a heat exchanger to reduce possible damage caused by freezing.

A heat exchanger is utilized to cool or heat a fluid medium by flowing two fluid mediums adjacent to each other through a core assembly. A heat exchanger is often configured such that atmospheric airflow is used as one of the fluid mediums. Humidity present within the atmospheric air can condense from the air and remain within portions of the core assembly as moisture.

Disadvantageously, moisture remaining within the core assembly can freeze as temperatures drop. Frozen liquid expands to a volume greater than the volume occupied when in the liquid state. Expansion caused by the frozen liquid can potentially deform portions of the core assembly. Subsequent thawing and freezing cycles can reduce the operational life of the heat exchanger.

Accordingly, it is desirable to develop a heat exchanger assembly that includes features that prevent moisture accumulation within the core assembly.

SUMMARY OF THE INVENTION

A heat exchanger assembly according to this invention includes a core assembly having air passages that are defined at least partially by a closure bar. A reinforcing bar is received within a channel of the closure bar to create an interface with substantially no gaps to prevent accumulation of moisture within the core assembly.

The closure bar includes a C-shaped cross-section to provide desired strength at a relatively low weight. Each closure bar defines a side of an air passage through the core assembly. The closure bars are reinforced at distal ends by a reinforcing bar to facilitate attachment of a housing or other heat exchanger components to the core assembly. The reinforcing bars include a tab received within a channel of the closure bar such that no gaps are created that are capable of accumulating moisture. Because moisture is prevented from accumulating, there is no moisture present within the core assembly to freeze.

Accordingly, a core assembly fabricated according to this invention prevents the accumulation of moisture at the interface between the reinforcing bar and the closure bar. Without accumulated moisture, the potential damage caused by freezing moisture is substantially eliminated thereby increasing the operational life of the heat exchanger.

These and other features of the present invention can be best understood from the following specification and drawings, the following of which is a brief description.

DETAILED DESCRIPTION OF THE PREFERRED EMBODIMENT

Figure 1:
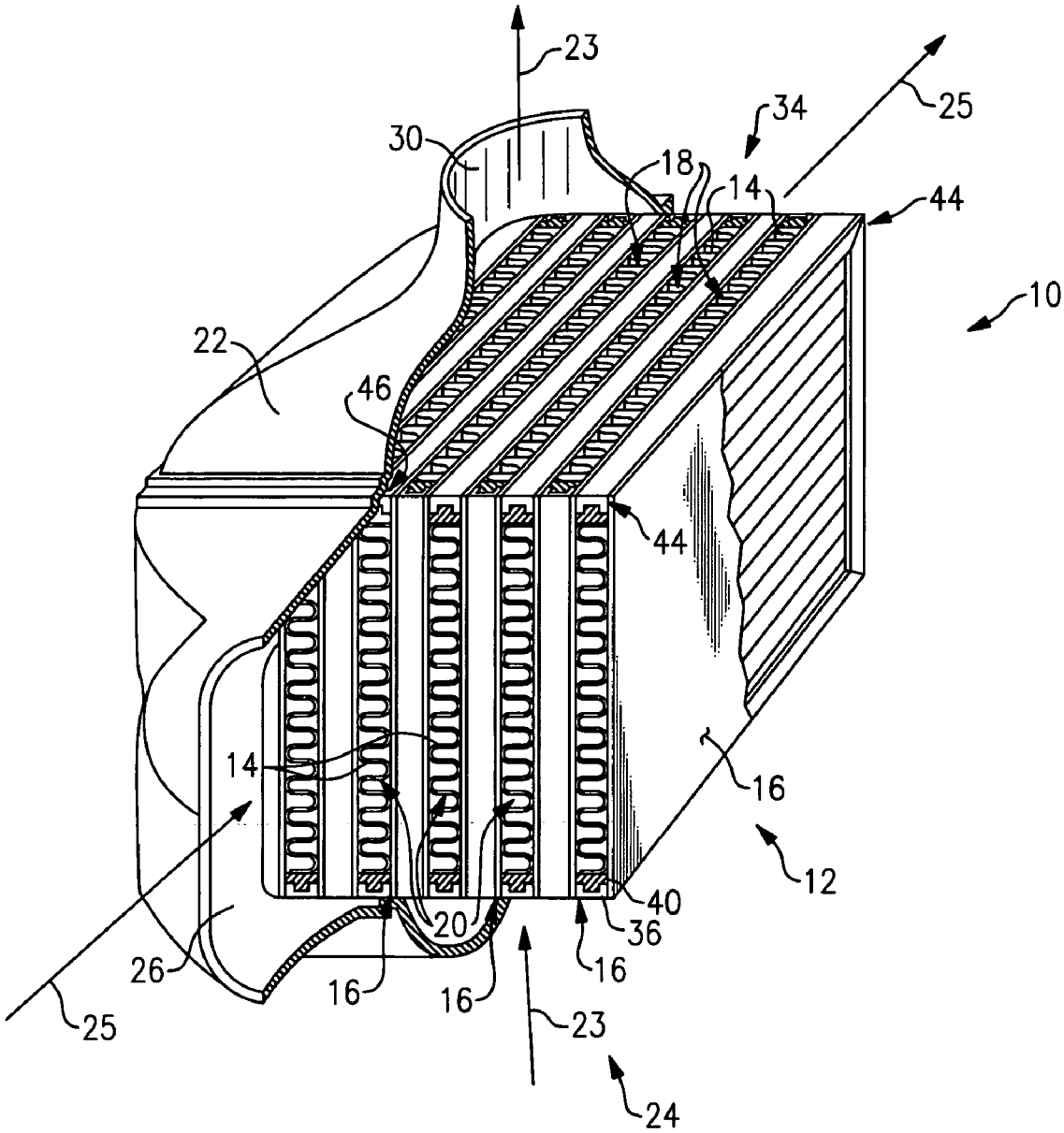
FIG. 1 is a schematic illustration of a heat exchanger including a core assembly according to this invention.

Referring to FIG. 1 a heat exchanger assembly 10 includes a core assembly 12 disposed within a housing 22. The housing 22 includes a first inlet 24 for a first medium 23 and a second inlet 26 for a second medium 25. The first and second mediums 23,25 exit through a first outlet 30 and a second outlet 34. At least one of the first and second fluid mediums 23, 25 comprises atmospheric air that contains a percentage of moisture as humidity. Although atmospheric air is described as an example fluid medium containing moisture, other fluid medium sources that contain a liquid that can condense and remain trapped within a core assembly are also within the contemplation of this invention, for example exhaust air from a combustion engine.

The core assembly 12 defines air passages 18 and 20 for the first and second mediums 23,25 and contains a plurality of fins 14. The first and second air passages 18 and 20 are interspersed within the core assembly 12 to provide for thermal communication and transfer between the first and second mediums 23,25.

The first and second air passages 18,20 are defined by parting sheets 16 on two sides and by closure bars 36 on two sides. The closure bars 36 provide a desired support structure for the core assembly 12. The closure bars 36 are substantially C-shaped and mated to reinforcing bars 40. The C-shaped closure bars 36 provide the desired strength and thermal fatigue properties. The reinforcing bars 40 are disposed at distal ends 44 of at least some of the closure bars 36 to strengthen the core assembly 12 and provide an attachment point 46 between the core assembly 12 and the housing 22. Further, other features and components of the heat exchanger assembly 10 may also be attached at the interface between the closure bar 36 and the reinforcing bar 40.

Figure 2:
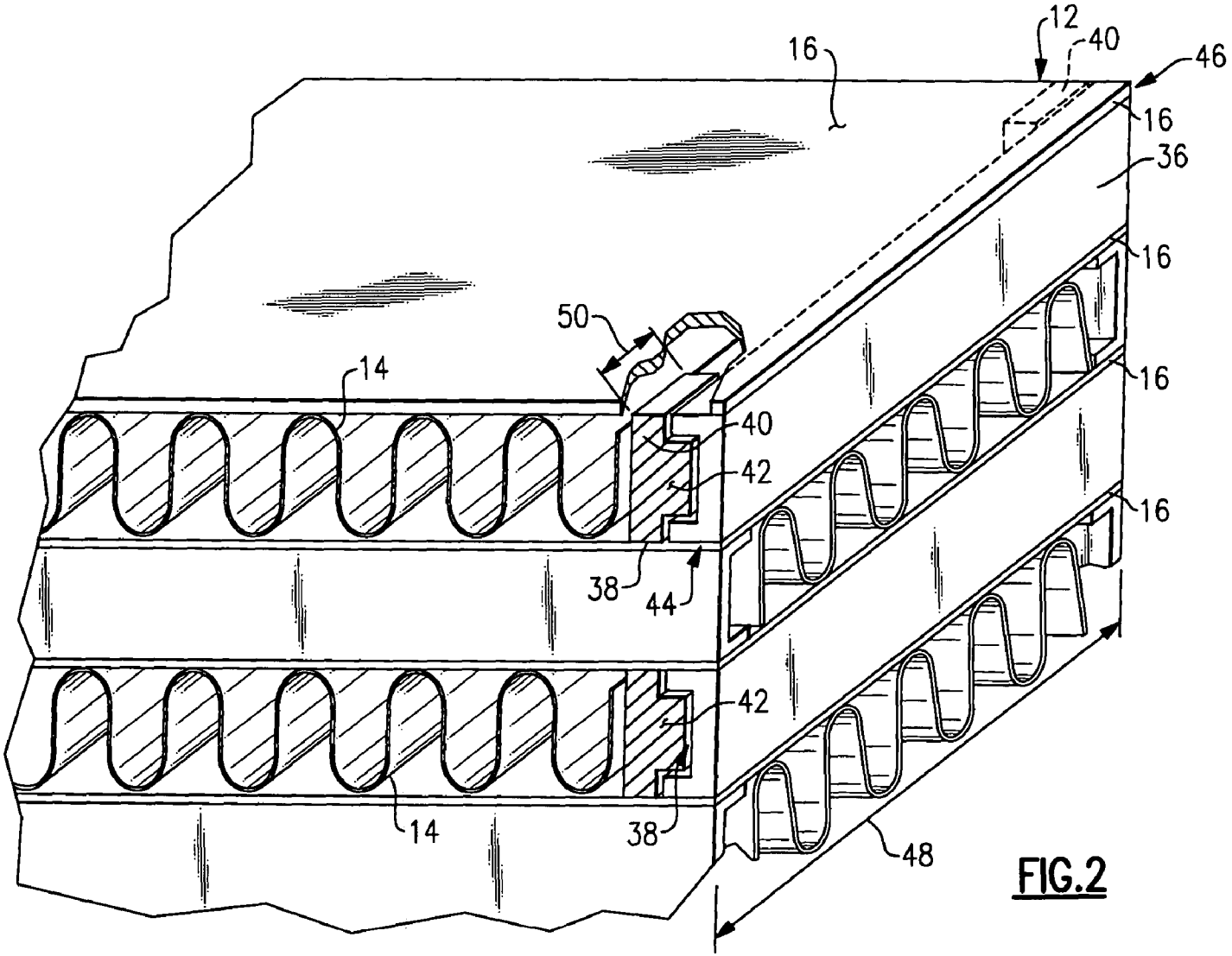
FIG. 2 is an enlarged schematic illustration of a portion of an example core assembly according to this invention.

Referring to FIG. 2, the closure bars 36 are substantially C-shaped and include a longitudinal extending channel 38. The closure bar 36 includes a length 48 and the C-shaped channel 38 extends the entire length 48 of the closure bar 36. The shape of the closure bar 36 provides the desired strength at a low weight to provide a desired low weight of the core assembly 12. Each of the reinforcement bars 40 includes a tab 42 received within the channel 38. The tab 42 is a substantial inverse shape of the C-shaped channel 38 such that no gaps are formed within the interface between the closure bar 36 and the reinforcing bar 40. The reinforcement bar 40 includes a length 50 that is less then the length 48. The reinforcement bar 40 extends only the length 50 necessary to provide for the strength to secure the attachment of other structures and mounting of the core assembly 12. The reinforcement bar 40 adds undesired weight to the core assembly 12 and as such it is desirable to minimize the length of the reinforcement bar 40.

The core assembly 12 is assembled by stacking fins 14, closure bar 36 and reinforcing bar 40 within parting sheets 16. A brazing material is utilized on the parting sheets 16 to attach each part to adjacent joining parts. Accordingly, the interface between each of the closure bars 36, reinforcing bars 40, parting sheets 16 and fins 14 fit within each other. Once the parts comprising the core assembly 12 are interfit within each other with the brazing material disposed at each interface with the parting sheets 16, the entire assembly 12 is heated to activate the brazing material and adhere the several core assembly parts together. The described assembly method for the core assembly 12 is only one such example of a fabrication technique that will benefit from the disclosure and application of this invention.

Figure 3:
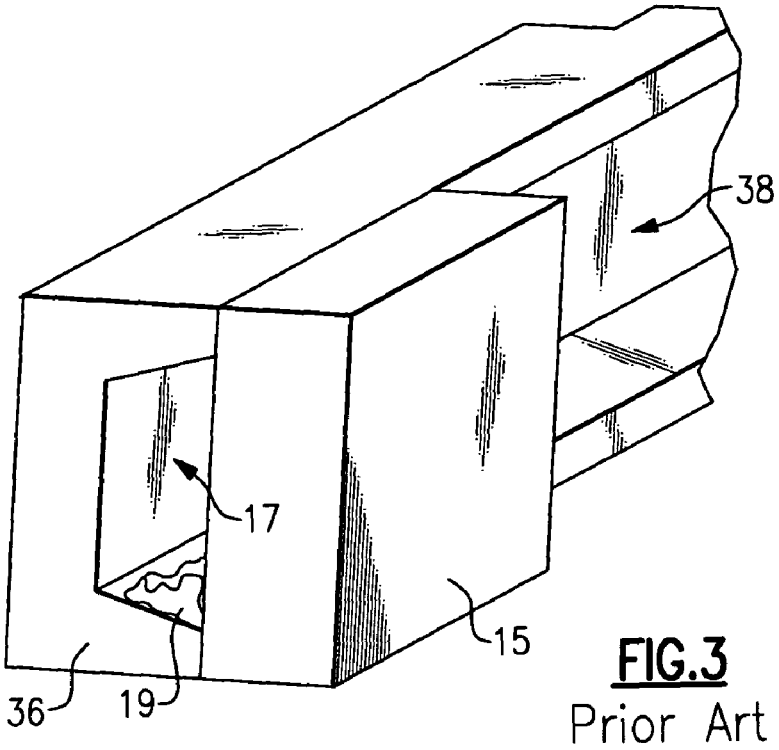
FIG.3 Prior Art
FIG. 3 is an enlarged schematic illustration of a prior art closure bar and reinforcement bar configuration.

Referring to prior art FIG. 3, a prior art interface between the closure bar 36 and a prior art reinforcement bar 15 is shown. During operation of the heat exchanger temperature fluctuations cause some portion of moisture trapped within the first and second fluid mediums to condense and accumulate as is schematically indicated at 19 in a gap 17 between the substantially rectangular prior art reinforcement bar 15 and the closure bar 36. Freezing of this moisture 19 can cause deformation of the closure bar 36 at the interface between the closure bar 36 and the reinforcement bar 15.

Figure 4:
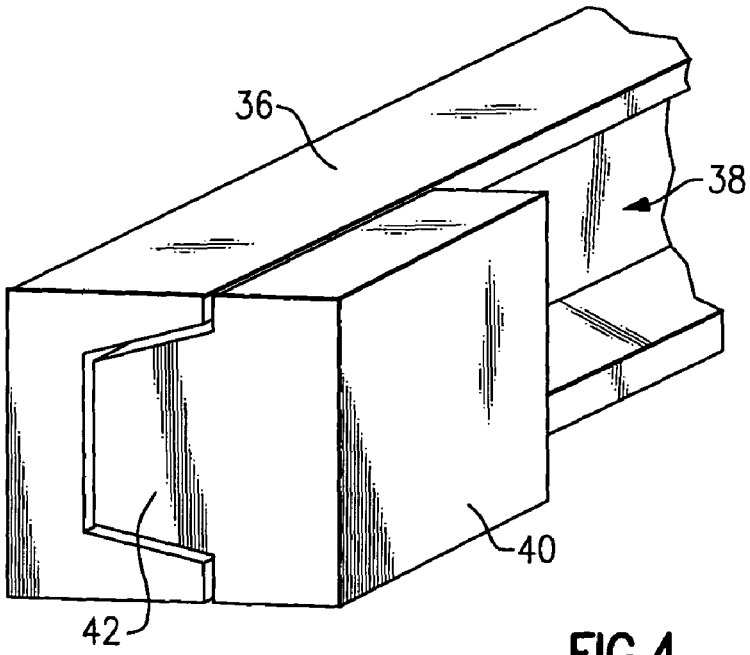
FIG. 4 is an enlarged schematic illustration of the example core assembly according to this invention.

Referring to FIG. 4, the reinforcing bar 40 according to this invention includes the tab 42 received within the channel 38 to prevent the formation of any gaps that could accumulate moisture. The tab 42 includes a cross-section that mates with the C-shaped channel 38 to prevent the formation of a gap therebetween. The tab 42 extends the length 50 of the reinforcement bar 40 such that substantially no gap is created at the interface between the closure bar 36 and the reinforcement bar 40. As should be appreciated, the tab 42 of the reinforcement bar may be of other configurations to conform to differently shaped channels of the closure bar 36.

The substantial elimination of any gap between the closure bar 36 and the reinforcement bar 40 prevents the accumulation of condensation within the core assembly 12. By preventing condensation build up, the potential deformation of the closure bars 36 caused by freezing is substantially eliminated. Because moisture is prevented from accumulating, there is no moisture to freeze, thereby preventing potential damage and potentially increasing operational life of the heat exchanger 10.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A core assembly for a heat exchanger comprising:

a plurality of parting sheets;

a plurality of fins disposed between the plurality of parting sheets;

a plurality of closure bars disposed between each pair of the plurality of parting sheets, where each of the plurality of closure bars includes an open channel that is open inward and an outside surface defining a portion of an outer perimeter of the core assembly; and a reinforcing bar including a tab portion received within and filling the inward open channel of the closure bar so that no gap exists between the reinforcing bar and the open channel.

2. The assembly as recited in claim 1, wherein the channel extends the longitudinal length of the closure bar.

3. The assembly as recited in claim 2, wherein the reinforcing bar is received within the channel along a longitudinal length less then the longitudinal length of the closure bar.

4. The assembly as recited in claim 1, wherein the closure bar comprises a generally C-shaped cross-section.

5. The assembly as recited in claim 4, wherein the tab portion of the reinforcing bar is received within the generally C-shaped cross-section.

6. The assembly as recited in claim 1, wherein the closure bar defines a portion of a perimeter of an airflow passage.

7. The assembly as recited in claim 1, wherein the reinforcing bar defines a connection point for attachment of a housing to the core assembly.

8. The assembly as recited in claim 1, wherein each of the plurality of fins comprises a continuous sheet including a plurality of alternating peaks extending between the corresponding parting sheets.

9. The assembly as recited in claim 8, wherein each of the plurality of fins abuts a surface of a corresponding reinforcing bar opposite the tab portion.

10. A core assembly for a heat exchanger comprising:

a plurality of fins disposed between a corresponding plurality of parting sheets;

a closure bar defining a portion of a perimeter of a flow passage through the core assembly, wherein the closure bar comprises a channel open inward between a corresponding pair of the plurality of parting sheets; and a reinforcing bar including a tab received within and entirely filling the inward open channel such that no gap exists between the tab and the open channel, wherein a side of the open channel opposite the tab is in abutting contact with one of the plurality of fins.

11. The assembly as recited in claim 10, wherein the channel extends a longitudinal length of the closure bar, and the tab of the reinforcing bar is disposed proximate end segments of the closure bar.

12. The assembly as recited in claim 10, wherein the closure bar comprises a substantially C-shaped cross-section.

13. The assembly as recited in claim 12, wherein the tab of the reinforcing bar comprises a cross-section that is received within the C-shaped cross-section.

14. The assembly as recited in claim 13, wherein each of the reinforcing bars is disposed between a corresponding closure bar and a corresponding one of the plurality of fins.

15. The assembly as recited in claim 10, including a housing attachable to a portion of the reinforcing bar.

16. The assembly as recited in claim 10, wherein the closure bar includes a first end portion and a second end portion and the reinforcing bar is disposed at each of the first end portion and the second end portion.

17. The assembly as recited in claim 10, wherein the closure bar extends along a longitudinal side of the core assembly.

18. The assembly as recited in claim 10, wherein each of the plurality of closure bars includes an outer surface that defines an outer periphery of the core assembly.

* * * * *